US007976439B2

(12) United States Patent
Abelbeck

(10) Patent No.: US 7,976,439 B2
(45) Date of Patent: Jul. 12, 2011

(54) EXERCISE DEVICE ENABLING ROTATIONAL MOVEMENT

(75) Inventor: Kevin Gene Abelbeck, Fort Collins, CO (US)

(73) Assignee: Abelbeck Partners, Ltd., Fort Collins, CO (US)

( * ) Notice: Subject to any disclaimer, the term of this patent is extended or adjusted under 35 U.S.C. 154(b) by 124 days.

(21) Appl. No.: 12/387,932

(22) Filed: May 8, 2009

(65) Prior Publication Data

US 2010/0285934 A1 Nov. 11, 2010

(51) Int. Cl.
*A63B 21/00* (2006.01)
*A63B 21/06* (2006.01)
*A63B 21/08* (2006.01)

(52) U.S. Cl. ..... 482/93; 482/92; 482/97

(58) Field of Classification Search ..... 482/14–15, 482/92, 94, 97, 104, 106–108, 111, 148; 434/247, 253, 254
See application file for complete search history.

(56) References Cited

U.S. PATENT DOCUMENTS

| | | | | | |
|---|---|---|---|---|---|
| 71,775 | A * | 12/1867 | Mattson | 482/92 |
| 3,531,111 | A * | 9/1970 | Shafer | 482/81 |
| 3,944,056 | A * | 3/1976 | Feehery, Jr. | 198/348 |
| 4,334,677 | A * | 6/1982 | Tata | 482/14 |
| 4,854,578 | A | 8/1989 | Fulks | |
| 5,044,632 | A | 9/1991 | Jones | |
| 5,273,505 | A | 12/1993 | Jones | |
| 5,554,089 | A | 9/1996 | Jones | |
| 5,788,615 | A | 8/1998 | Jones | |
| 5,885,193 | A * | 3/1999 | Habing et al. | 482/92 |
| 6,203,474 | B1 | 3/2001 | Jones | |
| 6,824,504 | B2 * | 11/2004 | Ott | 482/92 |
| 7,585,253 | B2 * | 9/2009 | Richards | 482/18 |
| 7,641,596 | B2 * | 1/2010 | Sharps | 482/51 |
| 7,662,075 | B2 * | 2/2010 | Isom | 482/97 |
| 7,803,092 | B2 * | 9/2010 | Gilliam | 482/92 |
| 7,806,813 | B2 * | 10/2010 | Campitelli | 482/138 |
| 2001/0001776 | A1 * | 5/2001 | Jones | 482/97 |
| 2003/0050153 | A1 * | 3/2003 | Stevens | 482/92 |
| 2005/0187076 | A1 * | 8/2005 | Mason | 482/93 |
| 2005/0227826 | A1 * | 10/2005 | Oga | 482/92 |
| 2005/0239612 | A1 * | 10/2005 | Keiser | 482/94 |
| 2006/0003873 | A1 * | 1/2006 | Kobayashi | 482/92 |
| 2006/0040799 | A1 * | 2/2006 | Pompile | 482/92 |
| 2006/0040800 | A1 * | 2/2006 | Slyter | 482/94 |
| 2006/0211549 | A1 * | 9/2006 | Nohejl | 482/97 |
| 2007/0142187 | A1 * | 6/2007 | Kolomeir | 482/92 |

(Continued)

OTHER PUBLICATIONS

Jammer, Catalog Sheet, Life Fitness, Inc.

(Continued)

*Primary Examiner* — Loan Thanh
*Assistant Examiner* — Sundhara M Ganesan

(57) ABSTRACT

An exercise device for simulation of the action familiar to "tire flipping" is provided, having a base frame with a rail, a carriage including a pair of supports and a guide arm coupled to the base frame and the carriage. The guide arm allows guided rotational displacement of the carriage relative to the base frame with the carriage also being supported by at least one support received by the rail of the base frame at all time. One or more weight horns may be used to add additional mass to the carriage. A brake may be used to control the downward movement of the carriage after the carriage is actuated over vertical by a user or a lift that is "missed" causing the carriage to be safely lowered to a starting position.

32 Claims, 13 Drawing Sheets

U.S. PATENT DOCUMENTS

2007/0155596 A1* 7/2007 Rogers et al. ..... 482/97
2007/0219072 A1* 9/2007 Kessler ..... 482/112
2007/0254790 A1* 11/2007 Adams ..... 482/148
2008/0004164 A1* 1/2008 Alsip ..... 482/93
2008/0312052 A1* 12/2008 Krietzman ..... 482/92
2009/0312160 A1* 12/2009 Higgins ..... 482/94

OTHER PUBLICATIONS

Squat Lunge, Catalog Sheet, Llfe Fitness, Inc.
Squat High Pull, Catalog Sheet, Life Fitness, Inc.

* cited by examiner

EXERCISE DEVICE ENABLING ROTATIONAL MOVEMENT

FIELD OF THE INVENTION

The present invention generally relates to exercise devices and, more particularly, to exercise devices adapted to simulate rotational displacement of a vehicle tire or similar object.

BACKGROUND OF THE INVENTION

Physical exercise has become a valuable part of everyday life. This is especially true regarding athletics. Athletes are constantly looking for an edge in an increasingly competitive environment. Success on the playing field or court may mean an athletic scholarship resulting in a paid college education or a career in the professional ranks. Training techniques may be inspired by different activities. Once such activity is the "Strong Man" competitions. In these, a variety of functional strength movements are used to test the strength and muscular endurance of athletes. One example is "tire flipping". This involves a large truck or tractor tire and a wide open space such as a parking lot or field. The athlete flips the tire by picking up one end of the tire rotating, it to be positioned on the tread and then flipping it over back to the ground.

As primitive an activity as this may sound, it has many advantages. Tires can weigh as much as 1000 pounds, so with a heavy tire, flipping is no trivial task. The movement starts with a driving dead lift from at or near ground level. As the tire is rotated up, the center of gravity of the tire moves closer to the pivot (ground contact positioned away from the user) thereby reducing the load on the athlete. This corresponds to the biomechanics of the athlete as the end movement is a combination bench press/military press where the athlete is less strong compared to the initial part of the lift. Movement from the ground to a throwing movement with the entire body extended follows the body's strength capacity and therefore may be an extremely effective exercise.

One of the disadvantages with the current technology is that the tire must be used outdoors, so weather may be an issue. Tire flipping is not conducive to use in a weight room setting due to space and safety issues of a heavy tire being thrown around. The tire weight is also a disadvantage. The process of progressive resistance is difficult to achieve with a tire as it is very difficult to add or subtract weight from a tire. If multiple tires are used, this adds to the storage space required. For desirable incremental loading of 10-20 pounds where a range of 500 to 1000 pound tires were used, the strength and conditioning coach would need to store and maintain up to 50 different weight tires. This makes tire flipping as a mode of highly efficient training impractical, if not impossible, for most individuals and institutions.

It should, therefore, be appreciated that there is a need for an exercise device that simulates the action of tire flipping and can be safely used in a confined environment such as a weight room and may alter the resistance of the device. The present invention fulfills this need and others.

SUMMARY OF THE INVENTION

The present invention provides an exercise device incorporating a base frame including a rail, a carriage including a pair of non-collinear supports moveably mounted to the carriage and a guide arm coupled to the base frame and the carriage enabling rotational displacement of the carriage relative to the base frame with at least one support received by the rail at all time. The supports may include wheels, bearings or rollers or any other structure capable of displacement under load bearing conditions.

In an embodiment of the invention, the carriage may include one or more weight horns adapted to receive weight plates. Two non-collinear weight horns may be used that are equally spaced from the center of mass of the carriage. The weight horns may be spaced such that with evenly distributed mass added to the carriage, the mass moment of inertia of the carriage and added mass is approximately equal to that of a tire or represented by the equation:

$$M/2*(L/2-5)^2+(L/2)^2$$

where "M" is the combined mass of the carriage with the added mass, and "L" is the length from a support to an end of the carriage. It may be the spacing of the horns would be between twenty-four and forty-six inches and more specifically between thirty-two and thirty-four inches apart for the mass moment of inertia of the system to approximate that as noted above.

A brake, such as a hydraulic damper may be coupled to the guide arm and supported by the base frame thereby enabling controlled downward movement of the guide arm and carriage relative to the base frame. The brake may be coupled to the base frame or coupled to a brake arm that is movably mounted to the base frame. A spring may be used to bias the brake to a position where the guide arm is elevated relative to the base frame.

A rear fit brake may be used to control the rotation of the carriage. The rear lift brake may be coupled to a rear portion of the base frame and adapted to engage a support on the carriage prior to contact with the rail of the base frame. Another system may be used to control the rotation of the carriage including a support gate with an ear moveably coupled to the base frame and adjacent to the rail. The ear in a first position restricts vertical displacement of the support on the carriage and in a second position the ear enables vertical displacement of the support and therefore the carriage.

An exemplary method for exercising according to the invention, for use with an exercise device as disclosed herein, includes the steps of a user grasping the first end of the carriage, lifting the first end of the carriage and displacing the carriage to past the vertical position and allowing the carriage to be guided by the rail and guide arm to present a second end of the carriage to the user.

For purposes of summarizing the invention and the advantages achieved over the prior art, certain advantages of the invention have been described herein above. Of course, it is to be understood that not necessarily all such advantages can be achieved in accordance with any particular embodiment of the invention. Thus, for example, those skilled in the art will recognize that the invention can be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following description of the preferred embodiments and drawings, the invention not being limited to any particular preferred embodiment(s) disclosed.

BRIEF DESCRIPTION OF THE DRAWINGS

Embodiments of the present invention will now be described, by way of example only, with reference to the following drawings, in which.

DETAILED DESCRIPTION OF THE INVENTION

Figure 1:
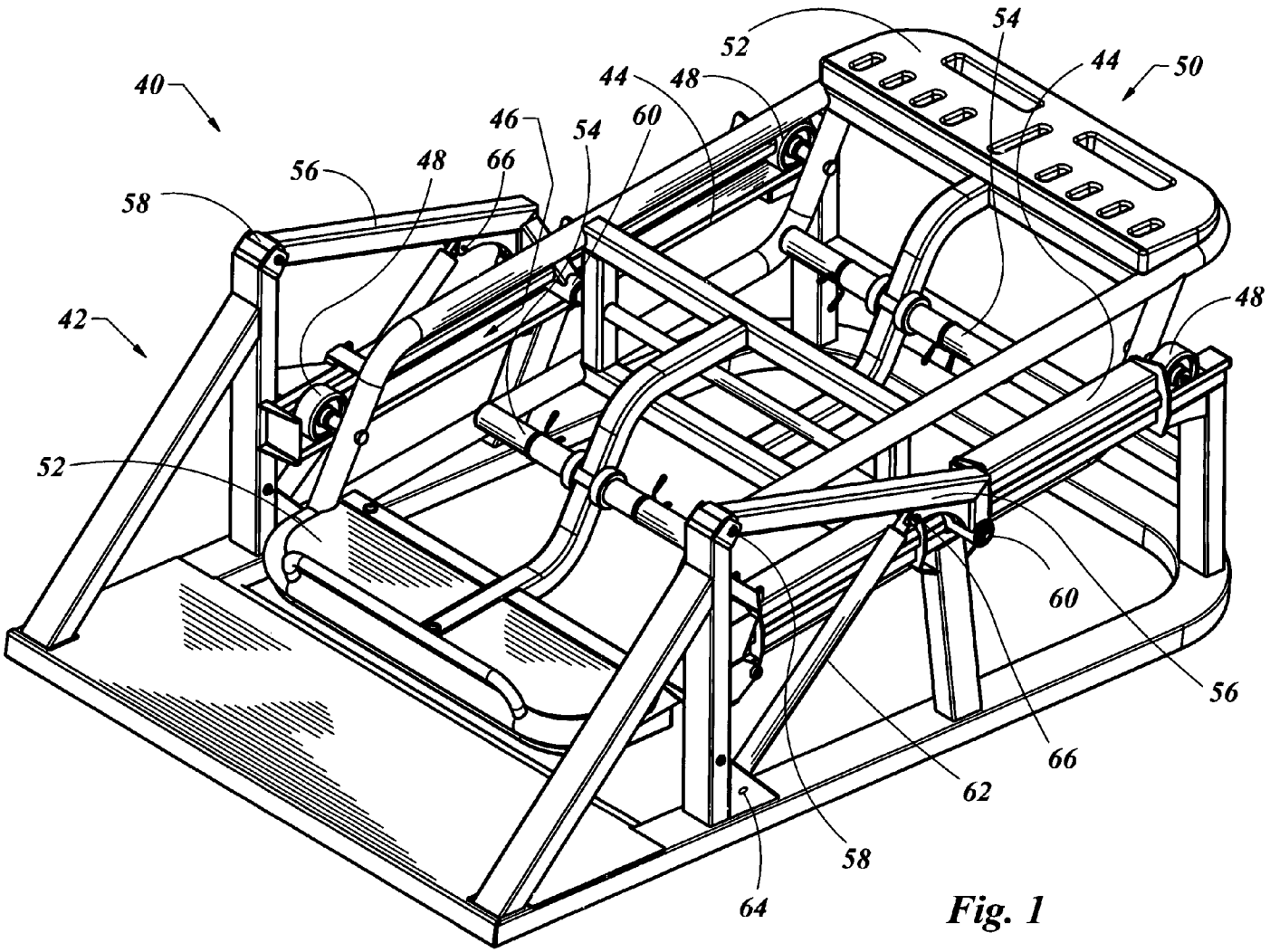
FIG. 1 is an isometric view of an exercise device incorporating a guided rotational capability in accordance with the present invention.

With reference to the illustrative drawings, and particularly to FIG. 1, there is shown an exercise device 40 adapted to simulate rotation or "flipping" of a tire or similar object. In this figure the device 40 is as it would be positioned ready to be used. A base frame 42 includes two rails 44, one on each side of the base frame 42. A single rail 44 in the center of the base frame could be used, but for illustrative purposes, a two rail 44 design is shown throughout this disclosure. The rails 44 have a hollow interior 46 to allow a support 48 mounted on a carriage 50 to be received therein. In this embodiment the supports 48 are shown as rollers or wheels rotatably mounted to the carriage 50. This is only one embodiment of the supports 48 and may be comprised of any number of components such as wheels, bearings and rollers capable of supporting the carriage 50, as will be further illustrated. The carriage 50 may also include a lifting platform 52 on each end, suitable for grasping and pushing against to move the carriage 50 relative to the base frame 42. Weight horns 54 may also be added to the carriage 50 to facilitate adding mass to the carriage 50.

A guide arm 56 may have a first end pivotally coupled to the base frame 42 at a first axis 58 and a second end pivotally coupled to the carriage 50 at a second axis 60. The second axis 60 may be positioned at or near the center of mass of the carriage 50. A brake 62 may be used to slow the decent of carriage 50 relative to the base frame 42, as will be explained in more detail later in the disclosure. The brake 62 may take any number of forms. Here, a hydraulic damper or any cylinder capable of offering a resistance to compression is an example of what may be used. In this embodiment, the brake 62 has a cylinder end that may be pivotally coupled to the base frame 42 at a cylinder axis 64 and a rod end which may be pivotally coupled to each guide arm 56 at a rod axis 66. If a compression only hydraulic damper is used for each brake 62, the brake 62 will extend with minimal resistance as the guide arms 56 are elevated. As the guide arms 56 are allowed to lower, the brakes 62 limit the velocity as the guide arms 56 and carriage 50 and allow them to safely lower into the position shown.

Figure 2:
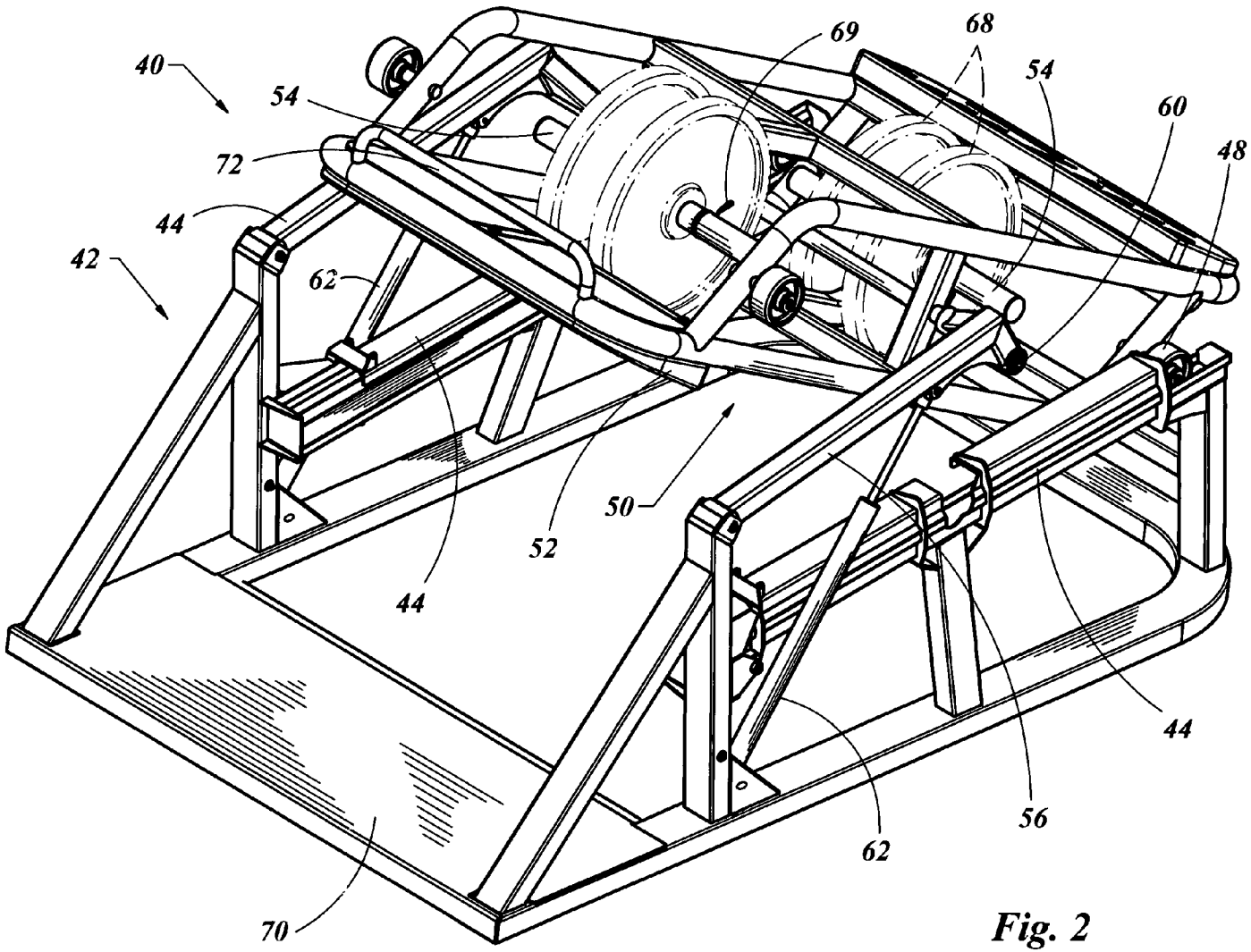
FIG. 2 is an isometric view of the device of FIG. 1 in a partially actuated position.

With reference to FIG. 2, the device of FIG. 1 is shown with the addition of weight plates 68 positioned on the weight horns 54 and the carriage 50 raised as it would be during use. Spring clips 69 or any other removable lock may be used to secure the weight plates 68 on the weight horns 54. To move the carriage 50, a user may stand on the platform 70 of the base frame 42 and grasp the lifting platform 52 or the lifting handle 72 of the carriage 50 and pull upward. The guide arms 56 may provide an arcuate or alternate path of travel for the center of the carriage 50. The supports 48 at the rear of the device 40 are drawn forward, toward the user and guided by the rails 44. The weight plates 68 offer additional resistance to the user and the addition of removal of weight plates 68 allows the device 40 to be easily customized for any strength or condition of athlete. If the user "misses" a lift, and thereby drops the carriage 50, the brakes 62 will provide a controlled decent of the guide arms 56 and the carriage 50 coupled to the guide arms 56, thereby greatly reducing the chances of injury to the athlete.

In this form of the invention and throughout the disclosure the guide arms 56 are shown to be pivotally coupled to the base frame 42. The purpose of the guide arms 56 is to guide the movement of the carriage 50 as it is lifted from the base frame 42. An alternative would be a linear or curvilinear track coupled to the base frame 42 and a roller or other guide member received therein and mounted to the carriage 50 at or near the second axis 60 of the carriage 50. The guide arms 56 pivotally coupled to the base frame 42 and the carriage 50 is considered a preferable design and is shown throughout this disclosure, but it is understood that a suitable alternative system could be produced in the manner described.

Figure 3:
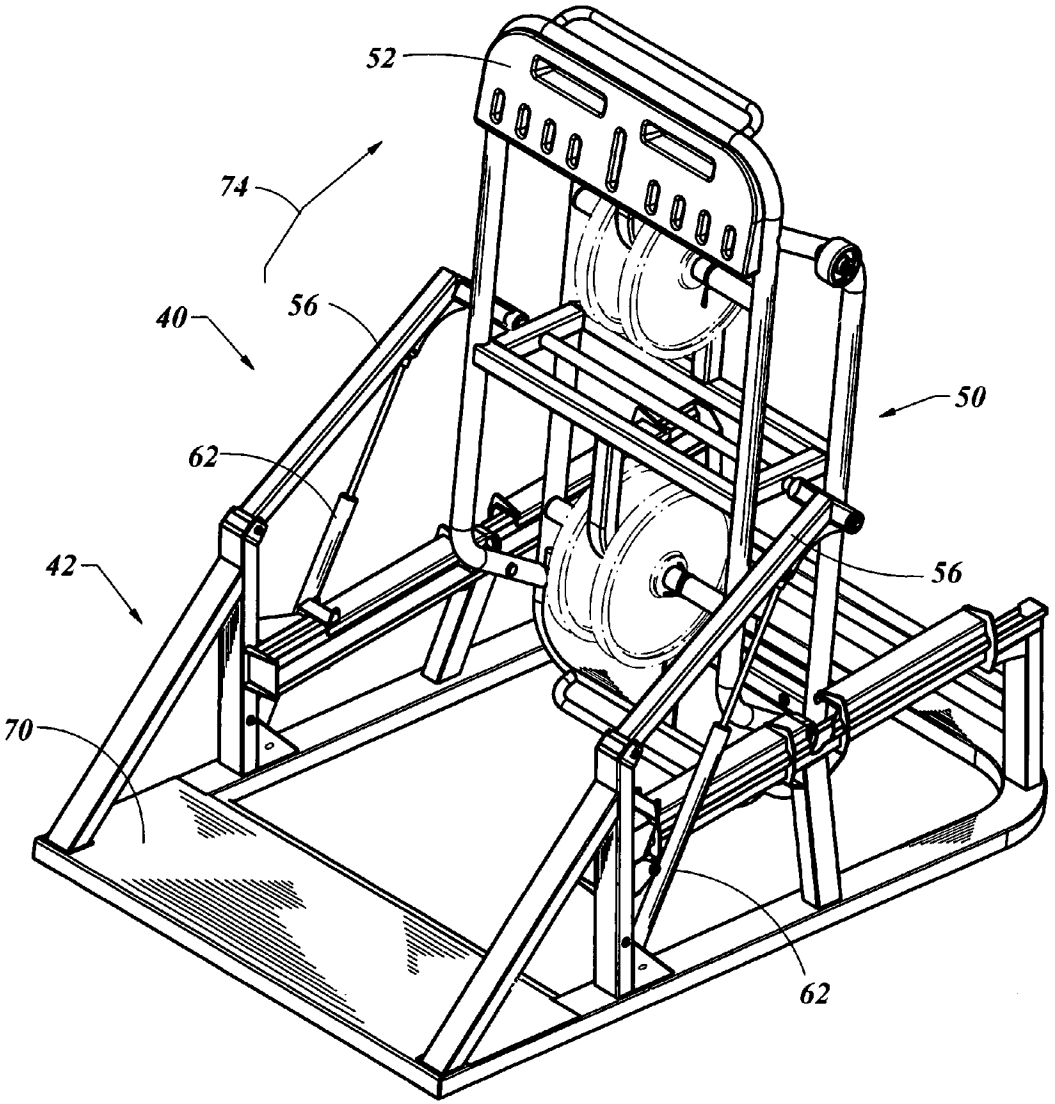
FIG. 3 is an isometric view of the device of FIG. 1 with the carriage in an elevated position, past that shown in FIG. 2.
Figure 4:
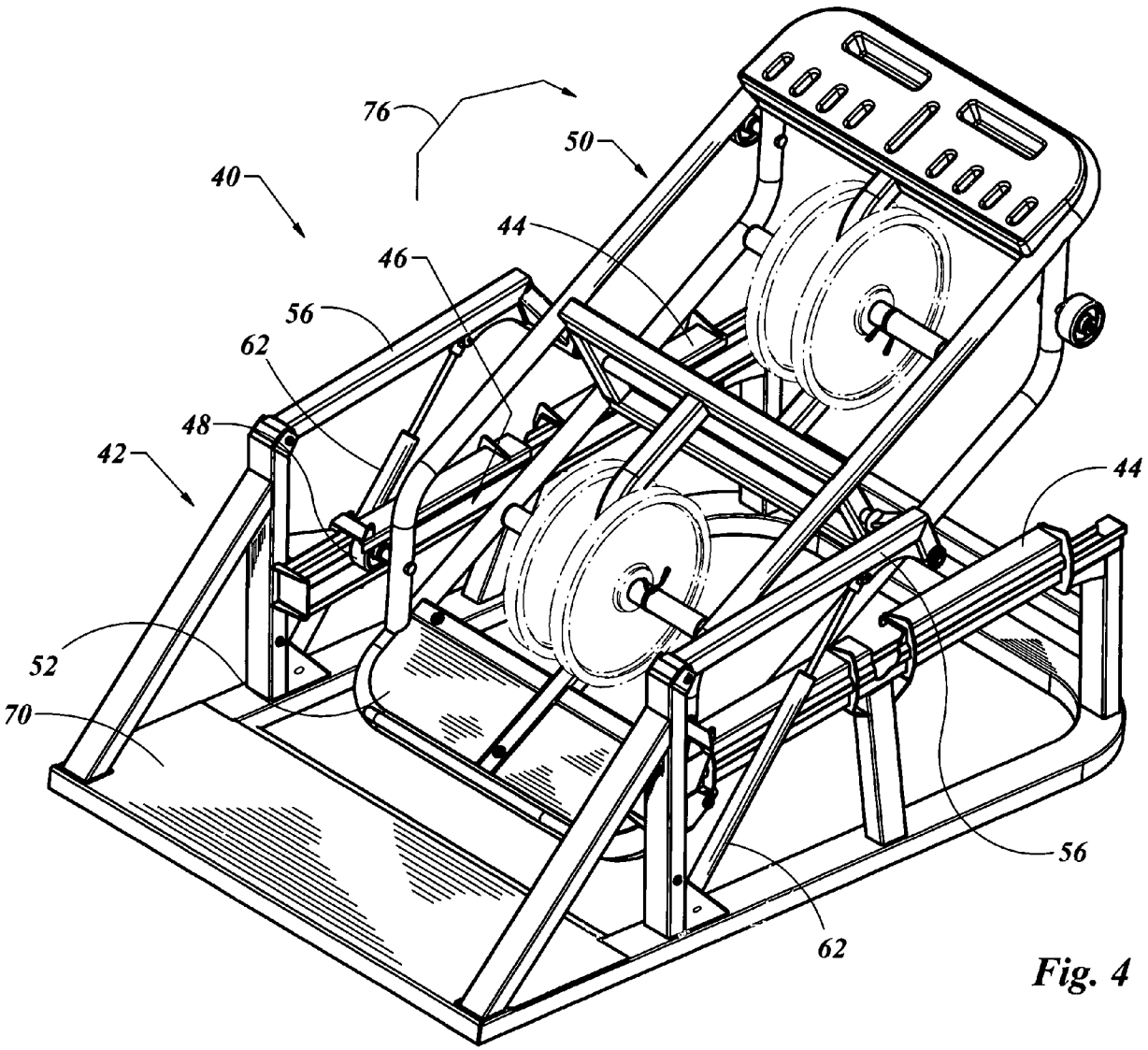
FIG. 4 is an isometric view of the device of FIG. 1 with the carriage rotated past that of FIG. 3.
Figure 5:
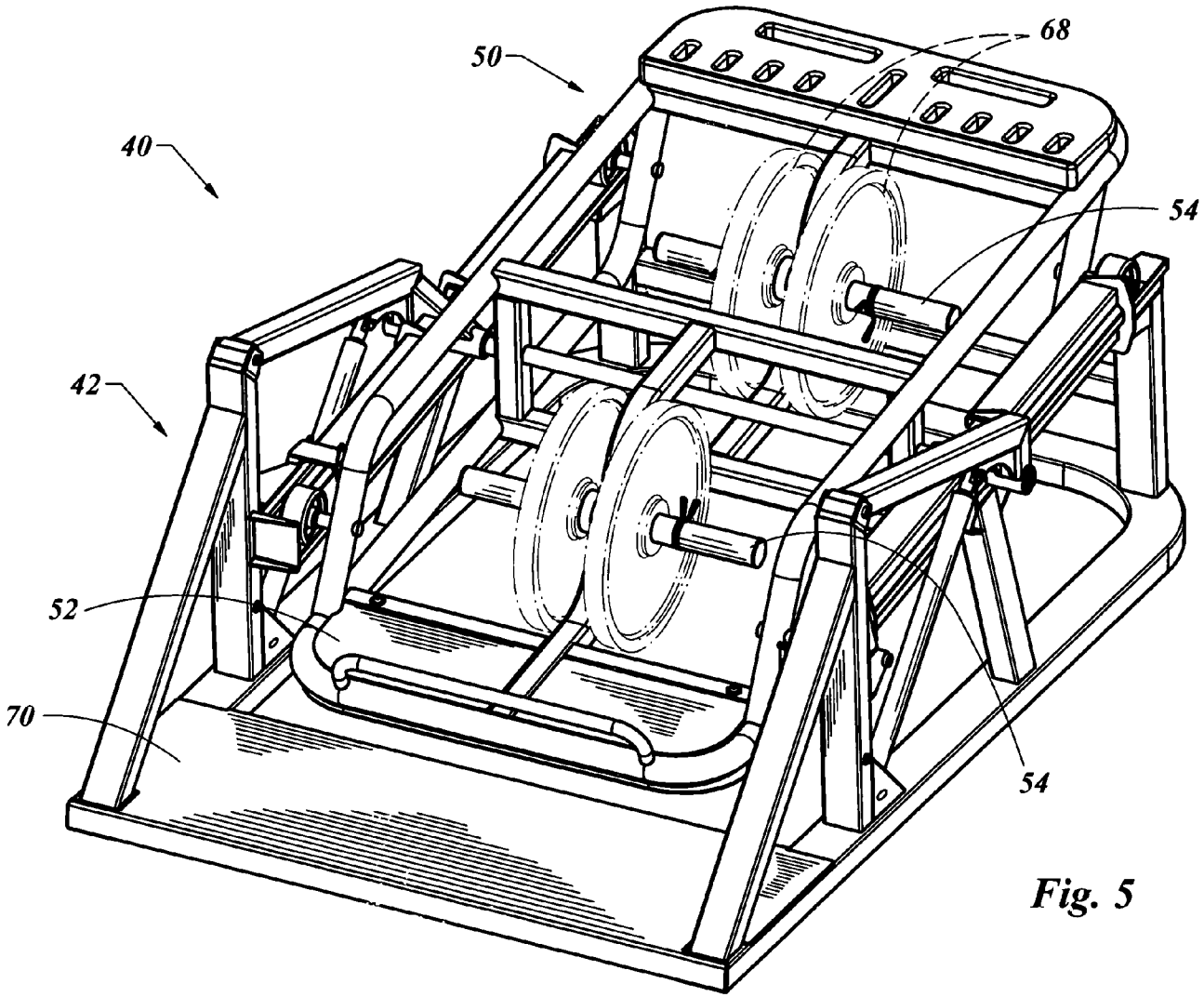
FIG. 5 is an isometric view of the device of FIG. 1 with the carriage back to a starting position.

With reference to FIGS. 3-5 and starting with FIG. 3, the carriage 50 is now elevated to a substantially vertical position relative to the base frame 42, the displacement of the carriage 50 is illustrated by the arrow 74. At this point the user may still be standing on the platform 70 of the base frame 42 with their hands pushing against the lifting platform 52. The user may explosively "throw" the carriage 50 away from their body by rapidly extending their arms and legs. The guide arms 56 are elevated to their highest position relative to the base frame 42 and the brakes 62 are likewise extended. The result of this action by the user is illustrated in FIG. 4. The arrow 76 depicts the rotation of the carriage 50 relative to the base frame 42.

The guide arms 56 allow a controlled and guided lowering or descent of the carriage 50 with the assistance of the brakes 62. The supports 48 nearest the platform 70 (and user thereon) are supported within the hollow interior 46 of the rails 44. During this phase, the user recovers and prepares for the next lift as the lifting platform 52 that was opposite the lifter, travels to a position in preparation to now be lifted. This is shown in FIG. 5, where the guided rotation of the carriage 50 provides the lifting platform 52 to again be positioned adjacent to the platform 70 and therefore the user, the carriage 50 is ready to be lifted again.

Figure 6:
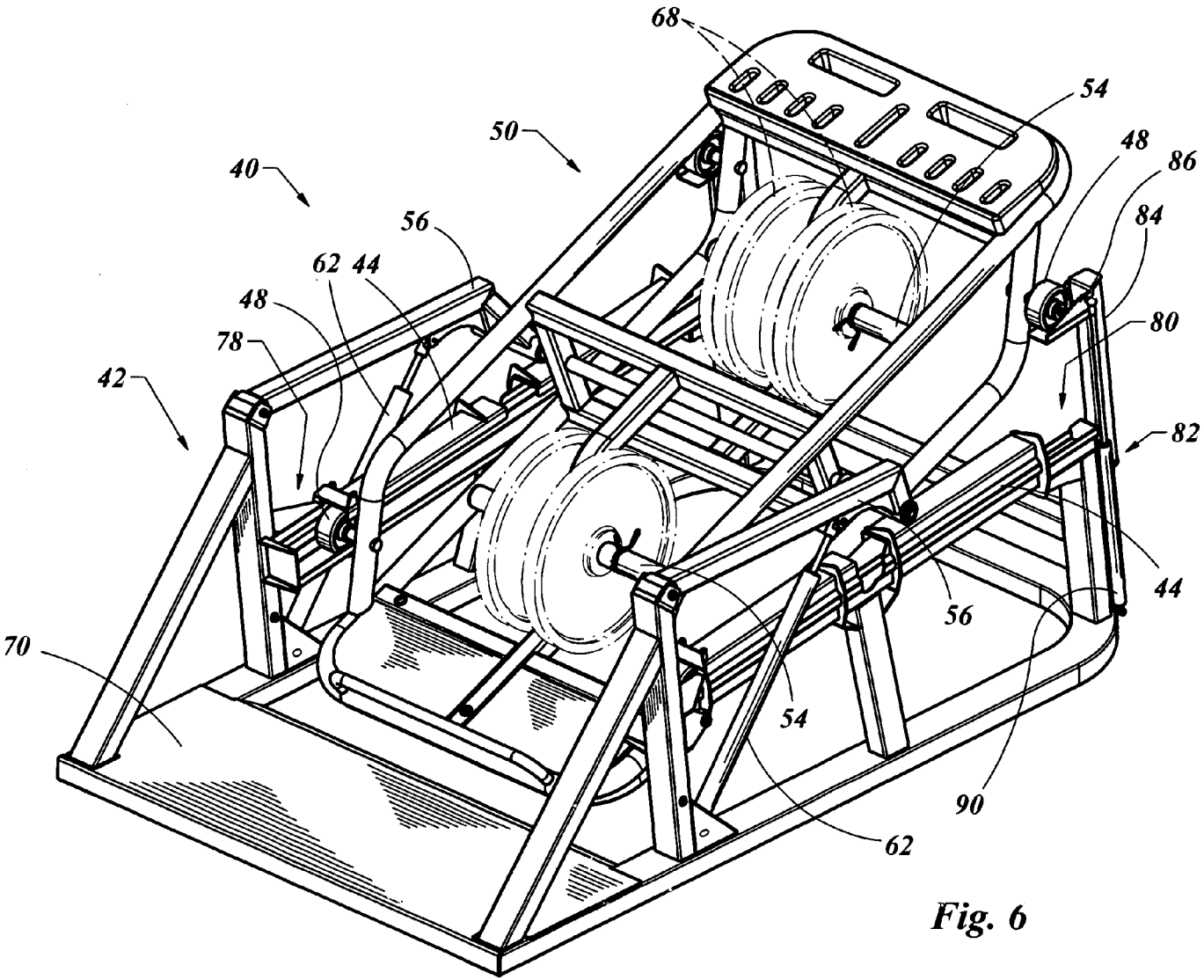
FIG. 6 is an isometric view of an exercise device incorporating a guided rotational capacity in accordance with the present invention with a raised rear lift used to prevent over rotation of the carriage.

In the event that one weight horn 54 is loaded with more weight plates 68 than the other weight horn 54 an "over rotation" condition may exist. This is when the weight horn 54 farthest away from the platform 70 is loaded heavier than the weight horn 54 closer to the platform 70 while the carriage 50 is descending to the base frame 42. This condition is illustrated in FIG. 6. A total of four weight plates 68 on the weight horn 54 positioned away from the platform 70 and only two weight plates 68 are on the weight horn 54 nearest the platform 70. The load of the carriage 50 with the added weight plates 68 are again supported by the brakes 62 and the guide arms 56 are rotatably coupled to the carriage 50 at the center of mass of the unloaded carriage 50. Any off balanced mass creates an eccentric load, which is countered by a reaction force of the rails 44 against the supports 48 which are closest to the platform 70.

The rails 44 may include a front void 78 to allow the supports 48 to exit the rails 44 when lifted by the user. Also, a rear void 80 may be added to the rails 44 to allow a descending support 48 access to be received by the rail 44. The existence of the front void 78 in the conditions shown in FIG. 6 presents an issue to be addressed. The greater mass due to the four weight plates 68 away from the platform 70 means the supports 48 near the platform 70 will be contacting the upper flange of the rail 44 as opposed to the lower flange in order to counteract the moment caused by the eccentric load in the carriage 50. When the support 48 approaches the front void 78 in this situation, the carriage 50 would possibly abruptly rotate up, in the direction of a user positioned on the platform 70. As the brake 62 lowered the carriage 50 it would eventually right itself but any sudden movement toward a user may be a potential for concern.

Figure 7:
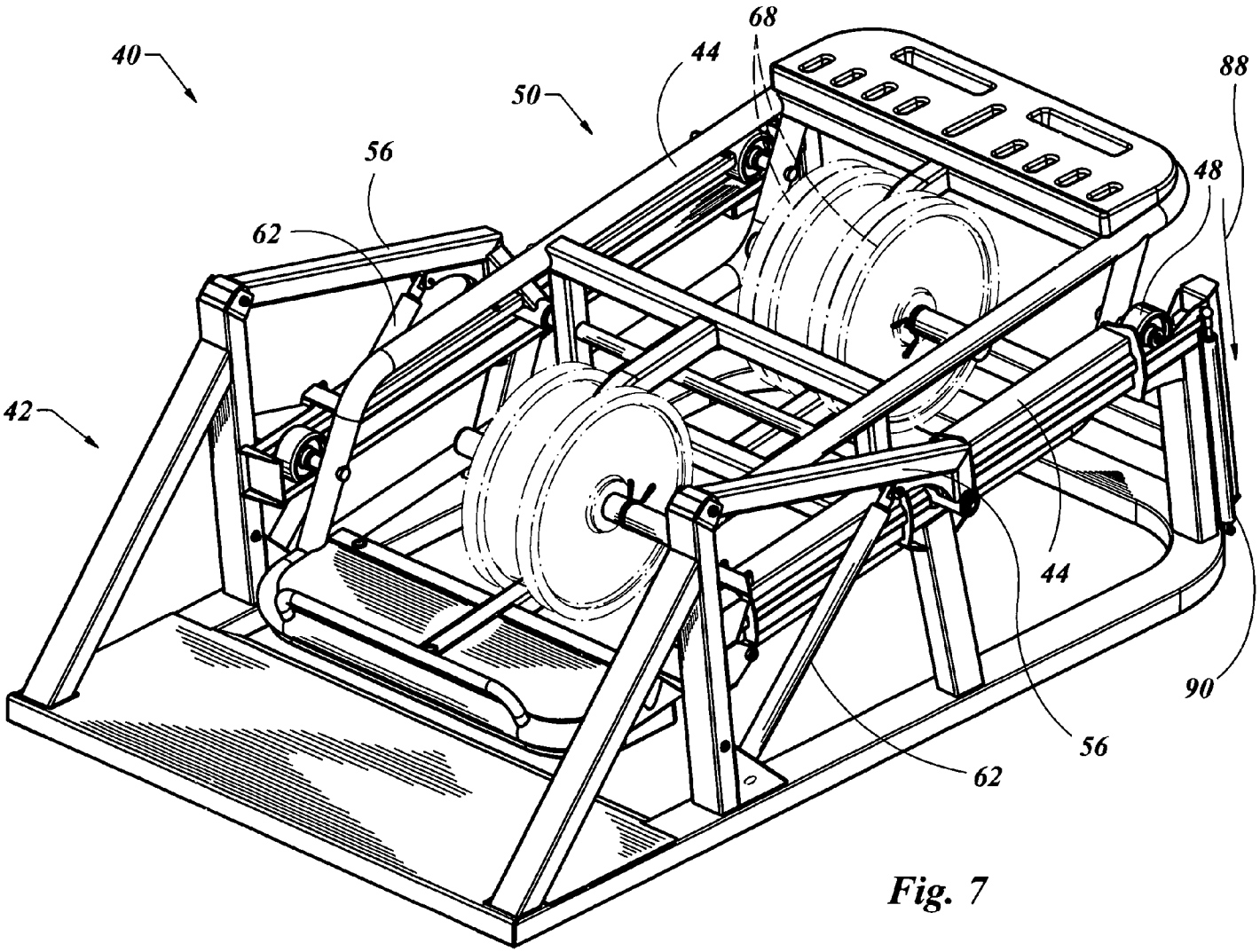
FIG. 7 is an isometric view of the exercise device of FIG. 6 with a lowered rear lift used to prevent over rotating of the carriage.

Two solutions to this have been developed and are shown here. The first is shown in FIG. 6 and FIG. 7 as a rear lift brake 82, one on each side of the base frame 42. In this embodiment the rear lift brake 82 is comprised of an arm 84 with an arm catch 86 on one end. The arm catch 86 may be positioned so as to receive the elevated supports 48 as the front supports 48 approach the front void 78. The arm 84 may be movably mounted on the base frame 42 so as to allow the carriage 50 to be smoothly lowered to a resting position with the rear supports 48 received in the respective rails 44 as is shown in FIG. 7 and illustrated by the arrow 88. The resistance to downward movement and therefore the offset to the rotation of the carriage 50 may be provided by the shock absorber 90 with one end mounted to the arm 84 or arm catch 86 of the rear lift brake 82 and the other end of the shock absorber 90 mounted to the base frame 42. A spring or other method of storing energy may be used to extend the shock 90 and therefore the rear lift brake 82, as the support 48 moves off the arm catch 86 when the carriage is again lifted by the user. This spring may be enclosed within the shock absorber 90, as illustrated here, or it may be an element external to the structure of the shock absorber 90. This will cause the rear lift brake 82 to extend to the position shown in FIG. 6 ready to receive the carriage 50 on the next repetition.

Figures 8, 9:
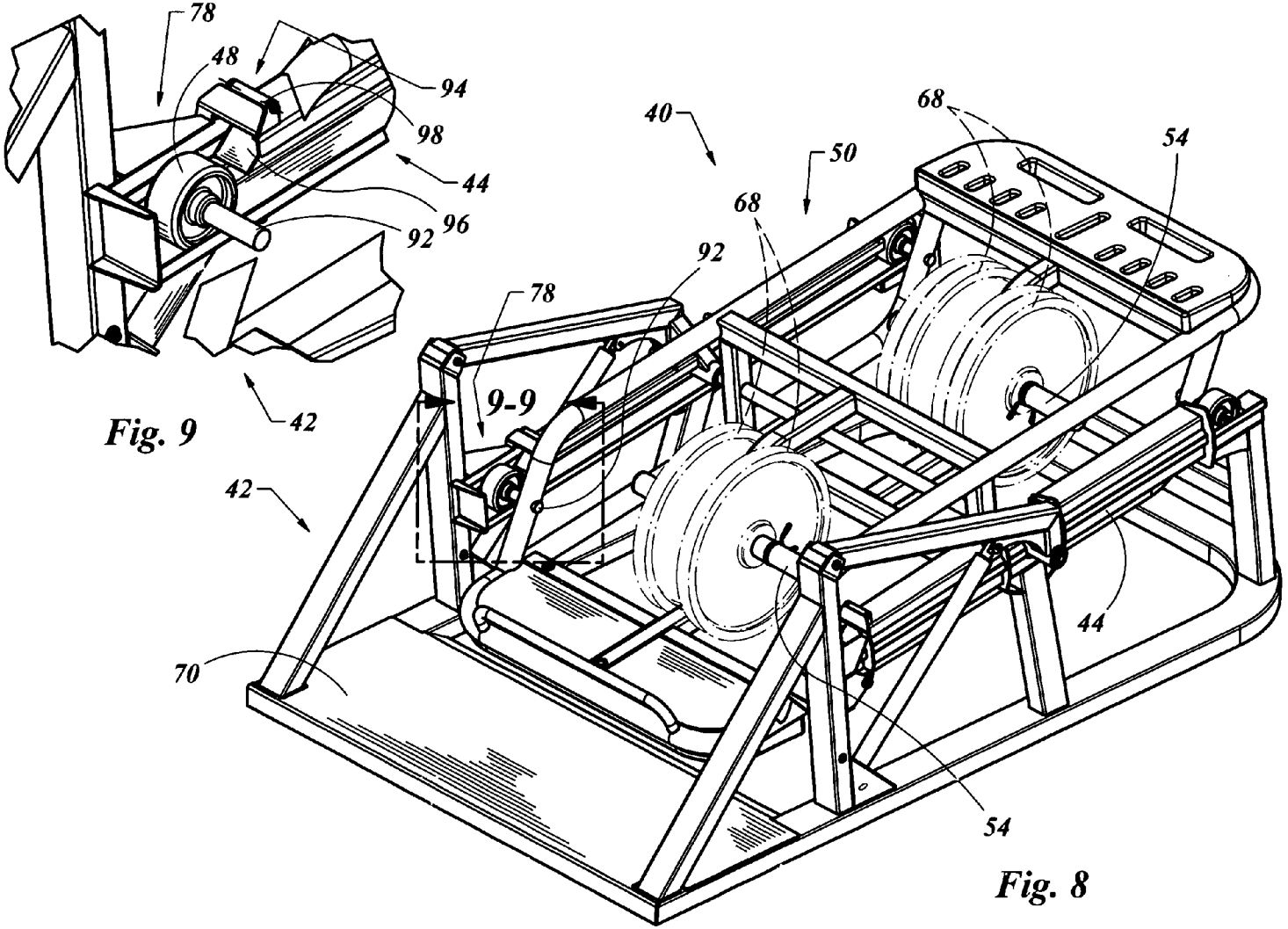
FIG. 8 is an isometric view of an exercise device incorporating a guided rotational capability in accordance with the present invention and a support gate to prevent over rotation of the carriage.
FIG. 9 is a cut away, detail of the front section showing the support gate, the detail cut across line 9-9 in FIG. 8.
Figure 11:
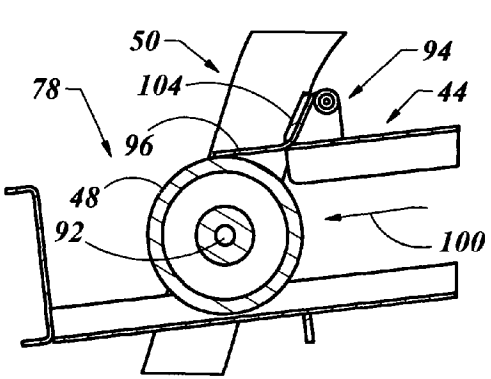
FIG. 11 is a side view of the action of the support gate as the support roller contacts and displaces the gate.

With reference to FIGS. 8-13, another embodiment of the invention with features intended to offset "over rotation" of the carriage 50 is presented. In FIG. 8 the device 40 is shown again in a "resting" state ready for a user to begin a movement by lifting the carriage 50. The weight horn 54 in the rear (away from the platform 70) has again been loaded with more weight plates 68 than is loaded on the front weight horn 54 to again illustrate the "over rotation" condition that would have been evident just prior to contact of the supports 48 positioned away from the platform 70 with the rails 44 of the base frame 42. In FIG. 9 a cut away is shown along line 9-9 in FIG. 8 showing a front support 48 positioned in the rail 44 adjacent to the front void 78. For illustrative purposes, the frame of the carriage 50 has been removed in FIG. 9 with the front axle 92 remaining. In FIG. 9 a support gate 94 is shown. The gate 94 may include an ear 96 movably coupled to the base frame 42 and as illustrated here pivotally mounted to the rail 44 about axis 98. An embodiment of the support gate 94 is sequentially shown in operation in FIGS. 10-13.

Figure 10:
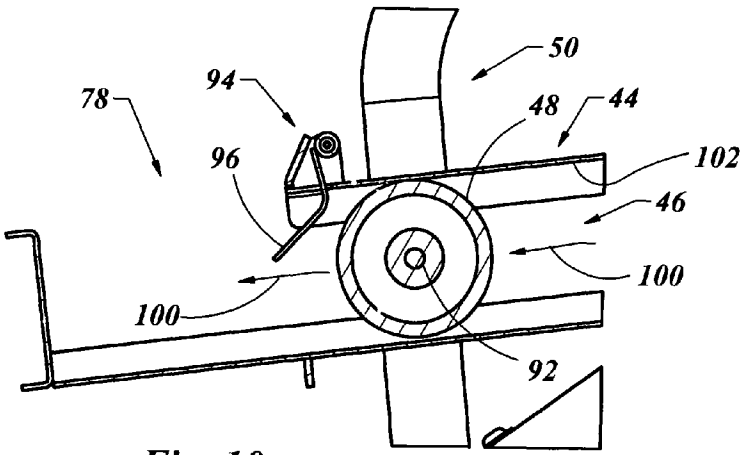
FIG. 10 is a side view of the action of the support gate as the support roller on the carriage approaches the gate.
Figure 13:
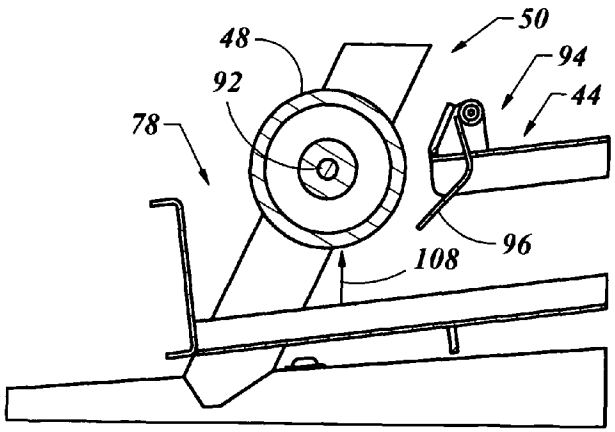
FIG. 13 is a side view of the action of the support gate as the support roller and carriage are allowed vertical movement.

In FIG. 10 a partial view of a front portion of the carriage 50 including a support 48 is shown as the support 48 is moving along the rail 44 toward the front of the device 40 (FIG. 8) and the support gate 94. This movement is illustrated by the arrows 100. As previously disclosed, this direction of movement of the support 48 happens as the rear of the carriage 50 is descending toward the rail 44 so as to be readied for the next lift. In this position, the support 48 has not yet contacted the ear 96 of the support gate 94. As such, the ear 96 is positioned in its resting position with the ear 96 extending into the hollow interior 46 of the rail 44. As shown in FIG. 8, the weight horn 54 at the rear of the carriage 50 has received more weight plates 68 than the front weight horns 54, thus producing a condition for "over rotation" of the carriage 50 as the support 48 reaches the front void 78 in the rail 44. As such, in FIG. 10 the support 48 is shown to be contacting the upper flange 102 of the rail 44.

As the support 48 moves further forward, as would happen as the carriage 50 continues to drop down, the support 48 may contact and displace the ear 96 of the support gate 94 up until the ear 96 hits an ear stop 104. This may substantially align the lower surface of the ear 96 with the upper edge 102 of the rail 44. This, in essence, temporarily extends the upper flange 102 of the rail 44 and temporarily reduces the size of the front void 78.

Figure 12:
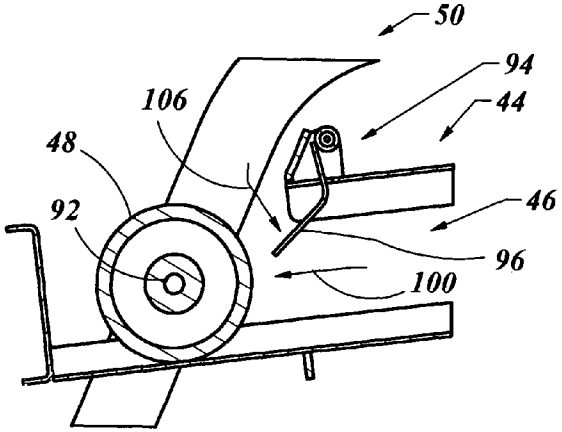
FIG. 12 is a side view of the action of the support gate as the support roller passes through the gate letting it fall into its relaxed position.

In FIG. 12, the support 48 is shown to continue to move in the direction of the arrow 100. Movement may continue to where the carriage 50 would be in a resting position to where the support 48 at the rear of the device 40 is also seated in the rail (as in FIG. 8). At this point, FIG. 12 illustrates the support 48 passing by the ear 96 of the support gate 94 so as to allow the ear 96 to fall back into the hollow interior 46 of the rail 44 as shown by arrow 106. This provides a sufficient gap as the original front void 78 dimensions have been restored and the support 48 is now able to be vertically displaced for another repetition, as depicted by the vertical arrow 108.

The object of the disclosed invention includes advantages of increasing muscular strength, muscular endurance and a great deal of caloric expenditure to assist in achieving desired body composition due in part to the massive amount of calories that can be expended from doing a great deal of work in every repetition. In addition, muscular power is a highly sought after physical quality in virtually every functional activity as well as on the field of play. To train for maximal physical power, speed of movement under load is necessary. Weight lifting, or Olympic lifting has been a standard used to develop muscular power. For this, the weighted bar is literally "thrown" up by the lifter and then caught. The catching and recovering for the next lift, or phase of lift, can be an area of injury to the athlete. The present invention eliminates the catch phase by the addition of the brake 62 and therefore reduces the likelihood of training injuries.

In order to optimize the physiological training effect, it may be desirable for the device 40 to allow for rapid vertical movements. The brake 62, when mounted directly to the base frame 42 as previously disclosed, may offer some resistance to movement as the brake 62 is being extended. This drag may throw off the athlete's "feel" during a lift. The mass moment of inertia of the carriage 50 may exactly equal that of a tire of a specific weight and size but if the brake 62 adds additional resistance to oppose vertical movement, it could cause a lifter to miss a lift or simply restrict higher velocity vertical movements associated with power training.

Figures 14, 15:
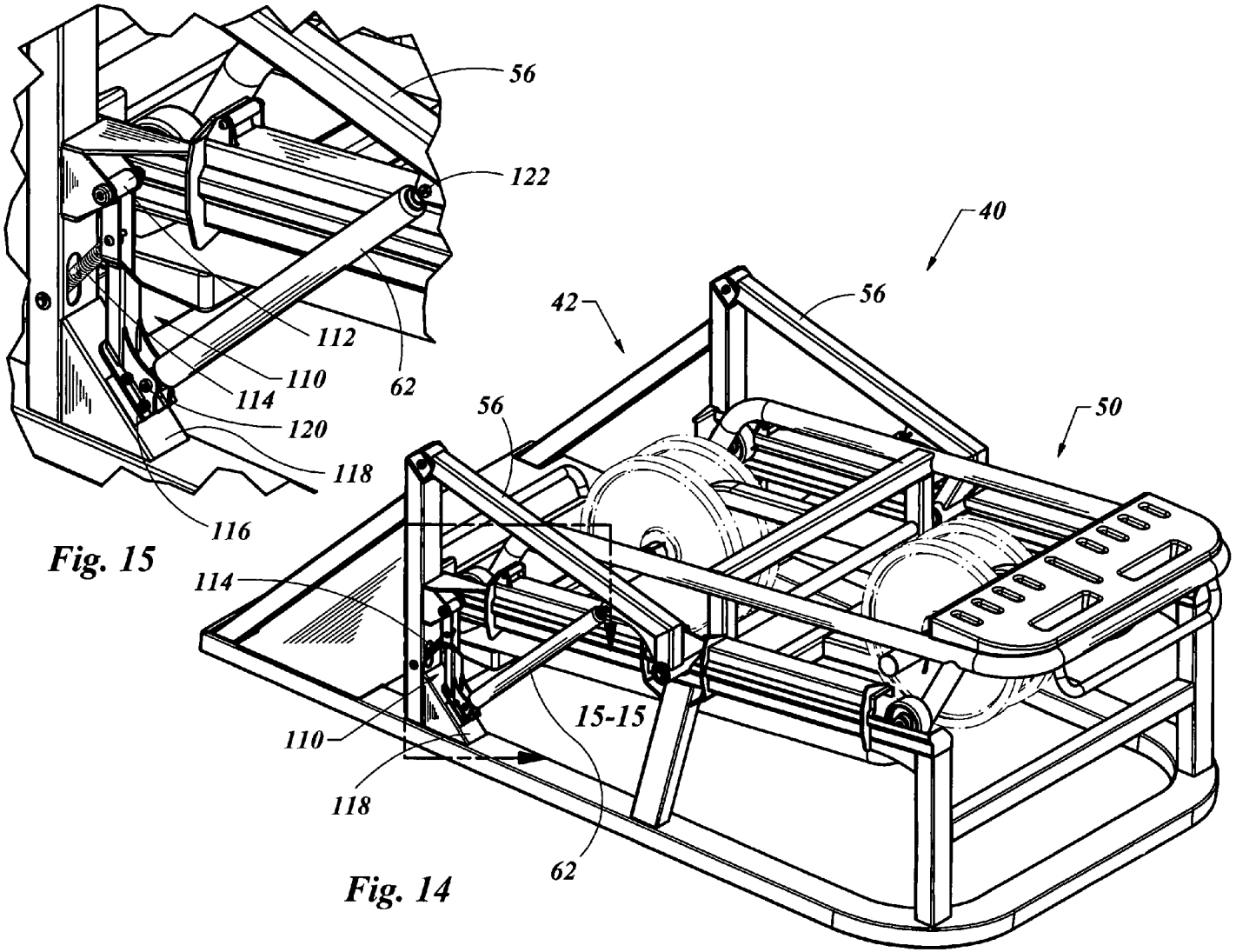
FIG. 14 is an isometric view of an exercise device incorporating a guided rotational capability in accordance with the present invention and including a brake arm coupled to the base frame.
FIG. 15 is a detailed view of the brake arm shown in FIG. 14 and cut along line 15-15.
Figure 16:
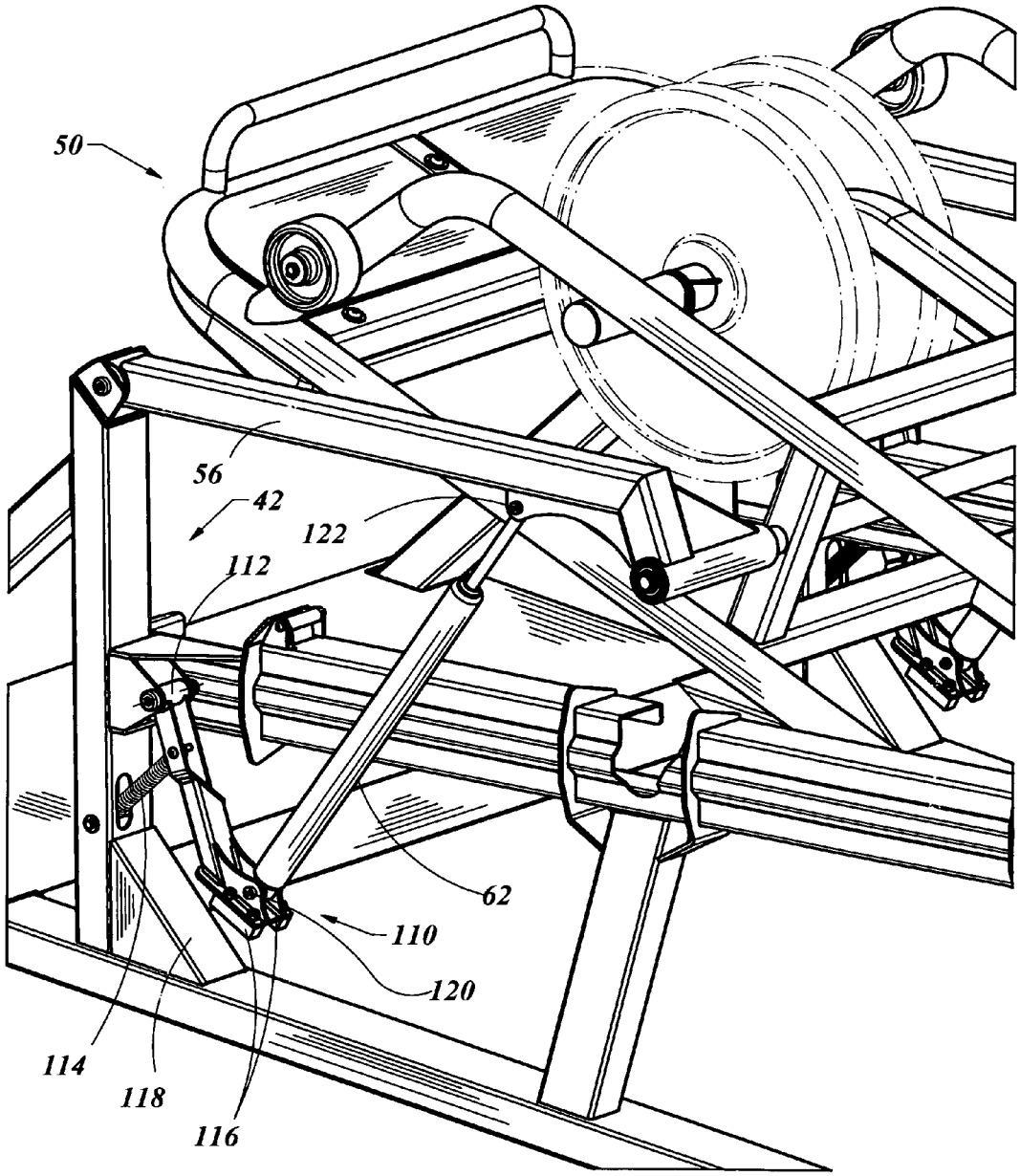
FIG. 16 is a partial view of the exercise device of FIG. 14 showing the brake arm elevated off the stop on the base frame.

To address the high velocity movement potential, a brake arm 110 is illustrated in FIGS. 14-16. In FIG. 14 the device 40 is in a resting position, the carriage 50 ready to be vertically displaced for the next lift. A cut-away along line 15-15 of FIG. 14 shows more detail of this embodiment of the brake arm 110 and associated components with the brake arm 110 in a lowered or resting position. In this position, the brake 62 functions similarly to that previously disclosed. As the guide arm 56 lowers, the brake 62 resists the downward movement. In this embodiment of the invention, if the guide arm 56 is displaced up faster than the brake 62 will allow, the brake arm 110 may be allowed to move relative to the base frame 42 as is shown in FIG. 16. This may be accomplished by the brake arm 110 being moveably mounted to the base frame 42. Here the brake arm 110 is pivotal mounted by way of a bolt 112. A counterweight or other bias such as a spring 114 may be used to position a foot 116, such as a pliable bumper stopper mounted on the brake arm 110 toward a support 118 on the base frame 42. The brake 62 may be coupled to the brake arm 110, shown here as a pivotal mounting at joint 120 on one end of the brake 62 and the other end of the brake 62 being mounted to the guide arm 56 at joint 122. This system allows for a buffer in the event that the brake 62 cannot extend rapidly enough to allow substantially free movement of the guide arm 56, and therefore the carriage 50, during the lifting phase. When the guide arm 56, and therefore also the carriage 50, are descending, the brake 62 may engage to slow their movement in a safe manner similar to that as previously disclosed.

The optimal "feel" of a "lift" performed by any athlete may be due to subtle changes in position, velocity or technique. The value to the exercise of a "ground to throwing" motion of lifting a mass from at or near ground level and continuing to full body extension and literally throwing the mass, has great potential. The amount of muscles used is substantial. The load to be lifted is potentially great as these are potentially large and powerful muscle groups used. Furthermore, the movement used in tire flipping is consistent with components of many athletic events from power lifting, to weight lifting, football, wrestling and numerous other sport activities. This is a testimony to the usefulness of the movement, as actual tires are used for tire flipping in spite of the list of limitations, including outdoor use only, large space required and the inability to alter the size and weight of a given tire, as presented herein. As such, the general use of the device 40 has many advantages for many athletes across the board. For a small population that train for strong man competitions where a test may be actual tire flipping, it may be desirable to simulate the feel of an actual tire in the device 40.

Figure 17:
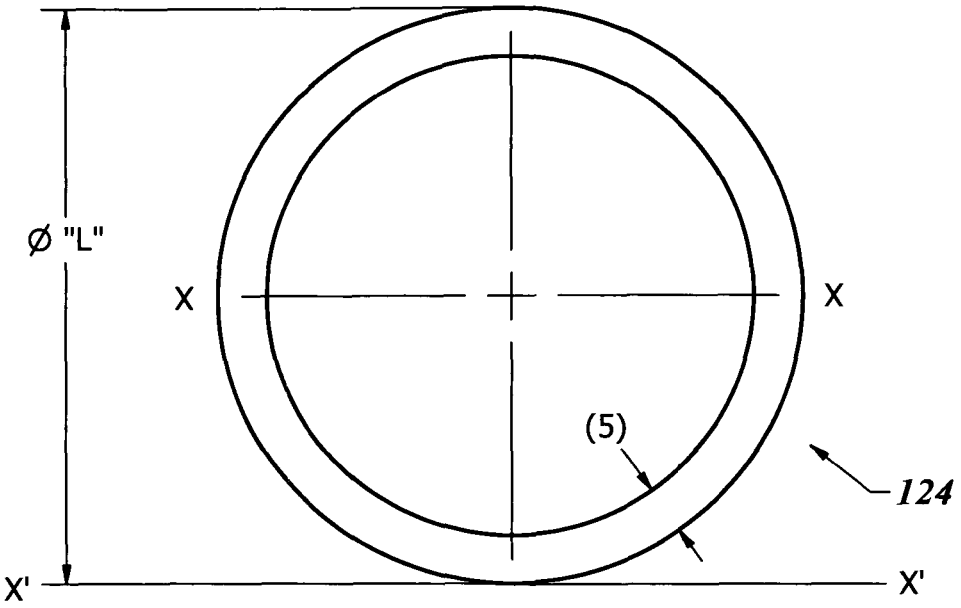
Prior Art Fig. 17
FIG. 17 is a schematic view of a simulation of a tire showing the Prior Art.

In FIG. 17 a simulated tire 124 is presented as Prior Art. For the purposes of the "feel" of flipping an actual tire, one of the areas to consider would be the mass moment of inertia of the tire. This is the distribution of the mass relative to the movement or in this case, the rotation, of the device 40. The mass moment of inertia of a cylindrical ring of an outside diameter "L" and a thickness of five inches (dimension generalized as typical for our purposes) with the axis of rotation extended to Line X'-X' would be characterized by the equation:

$$I_{X'X'}=M/2*(L/2-5)^2+M*(L/2)^2 \quad \text{(Equation 1)}$$

where "M" is the mass of the ring or tire. In order to reproduce the mass moment of inertia of the simulated tire in the device 40, the composite total of the structure of the device 40 and added weight plates 68 could be added and made equal to that of the ring or simulated tire, as depicted in Equation 1. In many cases where heavier lifts are done, the majority of the mass of the device 40 plus the weight plates 68 will be mass of the weight plates 68. Therefore. the appropriate location of the weight horns 54 relative to the center of mass of the device 40 would be desirable.

Figure 18:
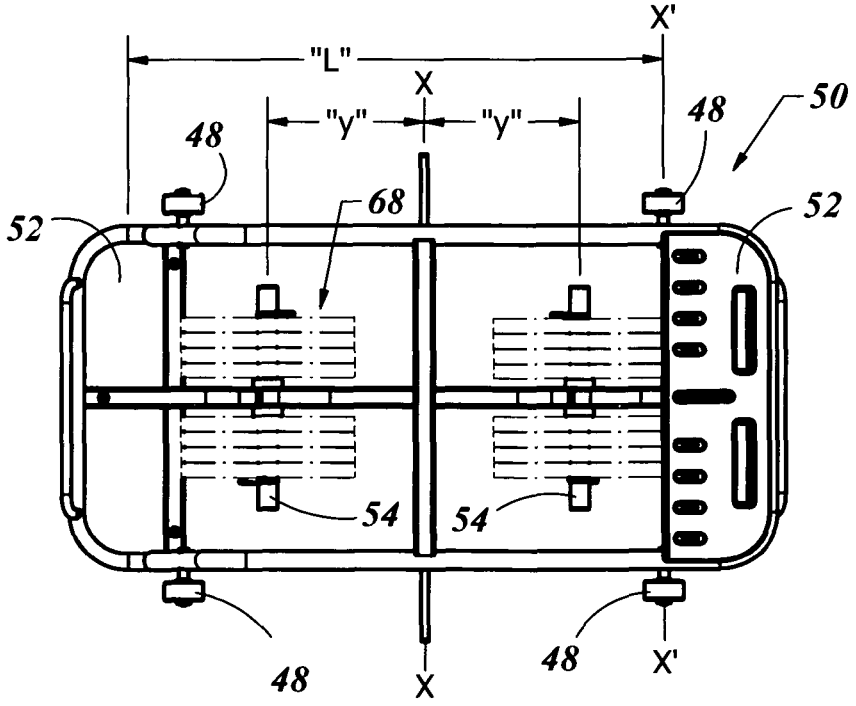
FIG. 18 is a top view of a carriage of the invention with weight plates received thereon illustrating a dimensional relationship relative to the Prior Art.
Figure 19:
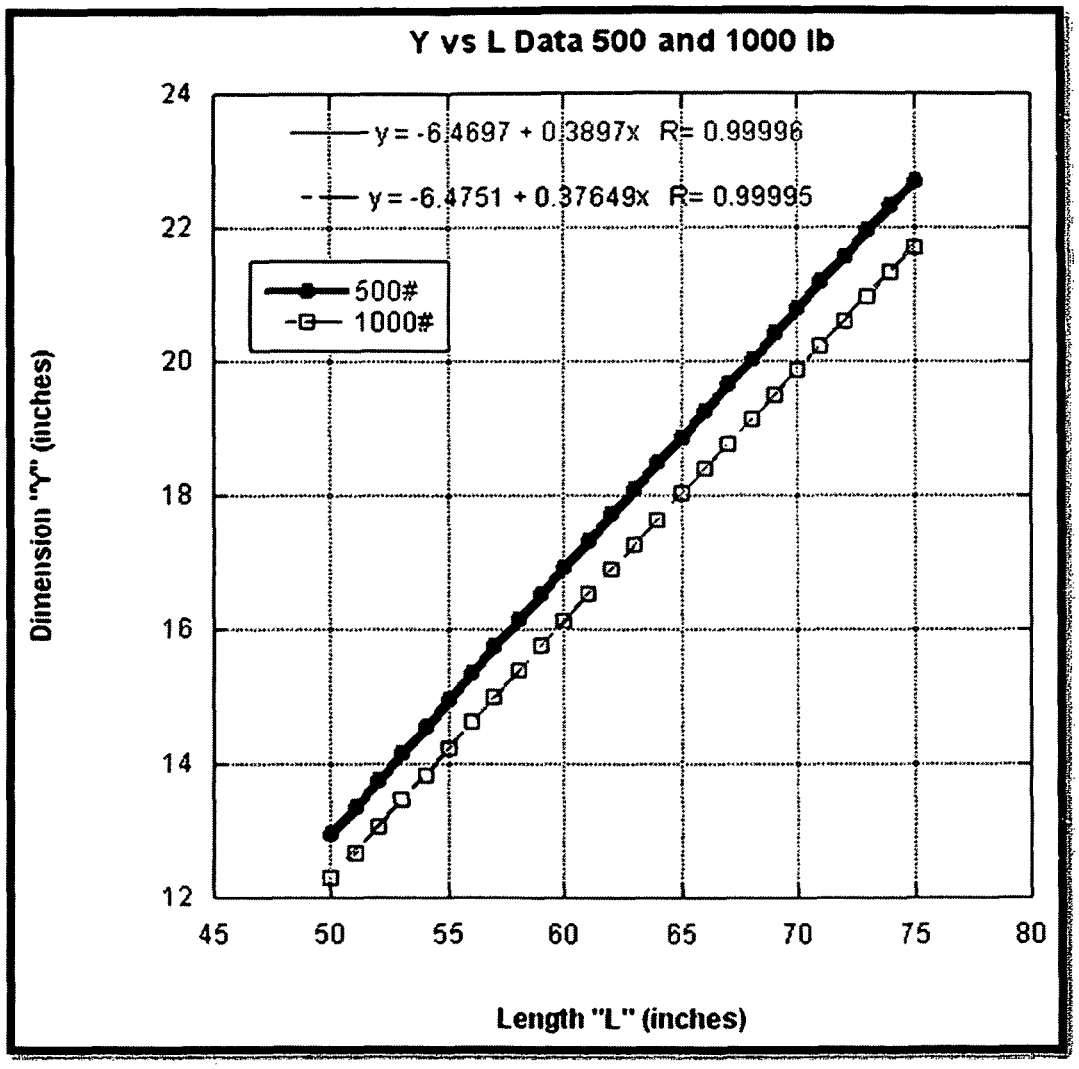
FIG. 19 is a graph depicting a calculated relationship between a distance between the weight horns and the length of an exercise device in accordance with the present invention.

In FIG. 18 a top view of the carriage 50 is shown with an evenly distributed mass of weight plates 68 on the weight horns 54. A generalized composite of the structure of the carriage 50 was constructed with the center of mass positioned along line X-X and translated to Line X'-X' by the parallel axis theorem. This line X'-X' is representative of the axis of rotation of the device 40 as presented in this disclosure. The distance "L" was generalized to be a position at or near a portion of the lifting platform 52. In this condition Line X-X may not be exactly centered on "L" depending on the position of the supports 48 relative to the shape and location of the end of the carriage 50. These are design considerations and not relevant to the novelty of the invention. The locations and dimensions have been generalized to apply to the device 40 in its general form. The mass moment of inertia of a generalized carriage 50 with a variety of evenly distributed weight plates 68 was calculated to be mathematically equal to Equation 1 above for different values of "L". The dimension "y" was determined to satisfy the mathematical equation under a combined mass range of 500 pounds to 1000 pounds. The results of the calculations are presented in FIG. 19. The math suggests an optimal relationship of the dimension "y" versus the length "L" for a 500 pound weighted carriage 50 is generalized in equation 2;

$$y=0.3897*L-6.470 \quad \text{(Equation 2)}$$

and in a similar manner, the relationship of the dimension "y" versus the length "L" for a 1000 pound weighted carriage 50 is generalized in equation 3.

$$y=0.3765*L-6.475 \quad \text{(Equation 3)}$$

Few athletes will lift over 1000 pounds and many high school and older athletes will lift over 500 pounds in the simulated tire weight, so these may be considered reasonable ranges.

The dimension "y" as shown in FIG. 18, is the distance on each side of the center of the carriage 50. Therefore the math reveals an optimal center to center range between the weight horns 54 of twenty-four to forty-six inches (12*2=24 to 23*3=46). A preferred dimension "L" may be 60 inches as a typical "tire" size for many athletes. As such, the math suggests an optimal "y" dimension of sixteen to seventeen inches. This suggests a desirable center to center dimension of the weight horns 54 as being twice that or thirty-two to thirty-four inches.

The foregoing detailed description of the present invention is provided for purposes of illustration, and it is not intended to be exhaustive or to limit the invention to the particular embodiment shown. The embodiments may provide different capabilities and benefits, depending on the configuration used to implement key features of the invention.

What is claimed is:

1. An exercise device, comprising:

a base frame including a rail;

a carriage including a pair of non-collinear supports and a weight horn adapted to receive at least one weight plate; and a guide arm coupled to the base frame and the carriage, enabling rotational movement of the carriage relative to the base frame, with at least one support of the pair of non-collinear supports being displaced from the rail and subsequently received by the rail during a complete rotational movement of the carriage.

2. The exercise device according to claim 1, wherein the supports are rotatably mounted to the carriage.

3. The exercise device according to claim 1, wherein the supports are selected from the group consisting of wheels, bearings and rollers.

4. The exercise device according to claim 1, wherein the carriage further includes a pair of weight horns.

5. The exercise device according to claim 4, wherein the pair of weight horns are non-collinear and equally spaced relative to a center of mass of the carriage.

6. The exercise device according to claim 4, wherein the pair of weight horns is positioned between twenty-four and forty-six inches apart.

7. The exercise device according to claim 6, wherein the pair of weight horns is between thirty-two and thirty-four inches apart.

8. The exercise device according to claim 1, further comprising a brake coupled to the guide arm and supported by the base frame thereby enabling controlled downward movement of the guide arm relative to the base frame.

9. The exercise device according to claim 8, wherein the brake is a hydraulic damper.

10. The exercise device according to claim 8, wherein the brake is coupled to the base frame.

11. The exercise device according to claim 8, wherein the brake is coupled to a brake arm, and the brake arm is movably coupled to the base frame.

12. The exercise device according to claim 8, further comprising a spring to bias the brake to a position where the guide arm is elevated relative to the base frame.

13. The exercise device according to claim 1, further comprising a rear lift brake coupled to a rear portion of the base frame and adapted to engage a support on the carriage prior to contact with the rail of the base frame.

14. The exercise device according to claim 1, further comprising a support gate including an ear movably coupled to the base frame and adjacent to the rail, the ear in a first position restricting vertical displacement of the support and in a second position enabling vertical displacement of the support.

15. An exercise device, comprising:

a base frame supporting a rail;

a carriage with a first support radially displaced from a second support, the first support and second support being sequentially received by the rail and disassociated from the rail during a complete rotation of the carriage relative to the frame, the carriage further including a weight horn adapted to receive at least one weight plate; and an arm with a first end coupled to the base frame and a second end coupled to the carriage.

16. The exercise device according to claim 15, wherein the first support and the second support are rotatably mounted to the carriage.

17. The exercise device according to claim 15, wherein the first support and the second support are selected from the group consisting of wheels, bearings and rollers.

18. The exercise device according to claim 15, wherein the carriage includes a pair of weight horns.

19. The exercise device according to claim 18, wherein the pair of weight horns are non-collinear and equally spaced relative to a center of mass of the carriage.

20. The exercise device according to claim 19, wherein the pair of weight horns is positioned between twenty-four and forty-six inches apart.

21. The exercise device according to claim 15, further comprising a brake coupled to the guide arm and supported by the base frame thereby enabling controlled downward movement of the guide arm relative to the base frame.

22. The exercise device according to claim 21, wherein the brake is a hydraulic damper.

23. The exercise device according to claim 21, wherein the brake is coupled to the base frame.

24. The exercise device according to claim 21, wherein the brake is coupled to a brake arm, and the brake arm is movably coupled to the base frame.

25. The exercise device according to claim 21, further comprising a spring to bias the brake to a position where the guide arm is elevated relative to the base frame.

26. The exercise device according to claim 15, further comprising a rear lift brake coupled to a rear portion of the base frame and adapted to engage a support on the carriage prior to contact with the rail of the base frame.

27. The exercise device according to claim 15, further comprising a support gate including an ear movably coupled to the base frame and adjacent to the rail, the ear in a first position restricting vertical displacement of the support and in a second position enabling vertical displacement of the support.

28. An exercise device for simulating tire flipping, including:

a base frame including a rail;

a carriage including a first support and a second support being independently received by and disassociated from the rail, the carriage including a weight horn adapted to receive at least one weight plate; and a guide means providing controlled complete rotation of the carriage relative to the base frame, whereby the first support and the second support are sequentially received by and disassociated from the rail during half of a complete rotation of the carriage.

29. The exercise device according to claim 28, wherein the carriage includes a pair of weight horns which are non collinear and equally spaced relative to a center of mass of the carriage.

30. The exercise device according to claim 29, wherein evenly distributed added mass on the weight horns gives the carriage a mass moment of inertia that is approximately representative of the equation: $M/2*(L/2-5)^2+M*(L/2)^2$, where "M" is the combined mass of the carriage and added mass and "L" is the length from a support on the carriage, contacting a portion of the guide means, to an end of the carriage.

31. The exercise device according to claim 28, further comprising a support gate including an ear movably coupled to the base frame, the ear in a first position restricting vertical displacement of the carriage and in a second position enabling vertical displacement of the carriage.

32. A method of exercise for use with an exercise device including a base frame with a rail; a carriage with a pair of non-collinear supports; and a guide arm coupled to the base frame and the carriage and enabling complete rotational movement of the carriage relative to the base frame with at least one support being displaced from the rail and subsequently received by the rail during a complete rotational movement of the carriage, the method of exercise including the steps of:

a user grasping a first end of the carriage;

lifting the first end of the carriage and displacing the carriage to past a vertical position; and allowing the carriage to be guided by the rail and guide arm to present a second end of the carriage to the user.

* * * * *